US012151721B2

(12) United States Patent
Romero et al.

(10) Patent No.: US 12,151,721 B2
(45) Date of Patent: Nov. 26, 2024

(54) LOCKED-AXLE WHEEL CRADLE, SYSTEM, AND METHOD

(71) Applicant: BNSF Railway Company, Fort Worth, TX (US)

(72) Inventors: Christopher M. Romero, Lawrece, KS (US); Henry R. Schafer, Smithville, MO (US); Timothy Webb, Topeka, KS (US); Mike E. Teaford, Topeka, KS (US); Edward M. Meyers, Grantville, KS (US); Ryan L. Kimberlin, Meriden, KS (US); Larry C. Valentine, Berryton, KS (US)

(73) Assignee: BNSF Railway Company, Fort Worth, TX (US)

( * ) Notice: Subject to any disclaimer, the term of this patent is extended or adjusted under 35 U.S.C. 154(b) by 0 days.

(21) Appl. No.: 18/365,349

(22) Filed: Aug. 4, 2023

(65) Prior Publication Data

US 2024/0101169 A1 Mar. 28, 2024

Related U.S. Application Data

(63) Continuation of application No. 17/934,960, filed on Sep. 23, 2022, now Pat. No. 11,724,723.

(51) Int. Cl.
*B61J 1/12* (2006.01)

(52) U.S. Cl.
CPC ..... *B61J 1/12* (2013.01)

(58) Field of Classification Search
CPC ..... B61J 1/12; B61K 5/00
See application file for complete search history.

(56) References Cited

U.S. PATENT DOCUMENTS

| | | | | |
|---|---|---|---|---|
| 2,491,034 | A * | 12/1949 | Couch | B61J 1/12 105/215.1 |
| 8,171,829 | B2 | 5/2012 | Thyni | |
| 9,925,991 | B2 | 3/2018 | Hou et al. | |
| 11,124,398 | B2 | 9/2021 | Moore | |

FOREIGN PATENT DOCUMENTS

| | | |
|---|---|---|
| CN | 112209293 A | 1/2021 |
| WO | 2020074197 A1 | 4/2020 |

* cited by examiner

*Primary Examiner* — Robert J McCarry, Jr.
(74) *Attorney, Agent, or Firm* — Whitaker Chalk Swindle & Schwartz PLLC; Enrique Sanchez, Jr.

(57) ABSTRACT

A crane-less locked axle cradle system configured to lift a rail vehicle wheel off a rail and transport the lifted wheel along a rail is presented. The present disclosure discloses a system that can lift the locked-axle wheel off the rail with no crane thereby allowing the train with a locked axle to be transported off the mainline in a shorter period of time. A cradle system can have two parts (male and female members with wedges and rail wheels) that can be mated with each other around a rail wheel. As the male and female members are pulled together, locked wheel engagers can couple with different portions of the locked-axle wheel, causing the locked-axle wheel to lift off the rail given the gradient of the wedge or rotation of the wheel. In another embodiment, the wheel lifting can be assisted by an air bag, hydraulic cylinder, jack, or other.

20 Claims, 9 Drawing Sheets

LOCKED-AXLE WHEEL CRADLE, SYSTEM, AND METHOD

CROSS-REFERENCE TO RELATED APPLICATIONS

The present application is a Continuation of U.S. patent application Ser. No. 17/934,960, filed Sep. 23, 2022, the entirety of which is hereby incorporated by reference for all purposes.

TECHNICAL FIELD

The present disclosure relates generally to wheel dollies, and more specifically to a locked-axle wheel cradle configured to lift and transport a locked-axle wheel.

BACKGROUND

As rail vehicles travel over a rail, they can become damaged by many hazards along the trip. Such damage can cause the rail vehicle to malfunction. One particularly troublesome malfunction is when an axle of a rail vehicle (e.g., locomotive, railcar, or other suitable vehicle) locks up and prevents the wheels of the rail vehicle from traversing a railroad track. Such condition can cause irreparable damage to the rail vehicle or even derailment. When a rail vehicle axle locks up during operation, the effect is that the main line stops. Further, staffing is affected as the current crew will typically be released to work on another train crew or rest. After losing a train crew, a first responder must be deployed to address the locked axle. Once the locked axle is identified, another response team must be deployed to address the locked axle. The locked axle rail vehicle is then transported via various means to a service location. The train having a locked axle must then wait for another crew to arrive to transport the train to its intended destination. Such delays can impact heavy losses for a railroad operator. Moreover, the losses are compounded as it is not only the effect of a particular locked-up rail vehicle, but every other train behind that has to stop. With hundreds of locked axle events every year, the effect on railroad operations cannot be overstated.

Traditional solutions to this problem have included: hiring an "oiler" to oil the railroad track to allow the wheel to "skid" to the nearest service location, cutting the pinion, or using a crane to lift the locked rail vehicle off of the line. The difficulties with having an oiler on hand is the labor burden of walking with a train for miles, periodically applying oil to the wheel or track, until the service location is reached. When cutting the pinion, there are many hazards that can cause harm to the responder and the rail vehicle including under-locomotive environment hazards and weather considerations. Employing a crane adds time and expense to the process, including blocking the main line. Other train wheel dollies exist, but they typically require a crane to lift the train to position the locked-axle wheel on a dolly. Understandably, these dollies are rarely used since a rail car is already being lifted with a crane, replacement of the offending axle may be just as easy.

SUMMARY

The present disclosure achieves technical advantages as a crane-less locked axle cradle configured to lift a rail vehicle wheel off a rail and transport the lifted wheel along a rail. The crane-less locked axle cradle can include a system of components to provide such functionality. In one embodiment, the present disclosure discloses a system that can lift the locked-axle wheel off the rail with no crane, thereby allowing the train with a locked axle to be transported off the main line in a shorter period of time. A locked-axle wheel cradle system can have two parts (male and female members with rail wheels) that can be mated with each other around a locked-axle wheel. As the male and female members are pulled together, locked wheel engagers can couple with different portions of the locked wheel. In another embodiment, the receiver member and the connector member can include a locked-axle wheel engager coupled to a respective receiver member and connector member and configured to engage a wheel (in some implementations, the axle need not be locked). For example, the locked-axle wheel engager can be a wedge, roller, wheel, ball, ramp, contoured section, or other suitable component. The male (connector) and female (receiver) members can be pulled together until fully-engaged, thereby causing the locked-axle wheel to lift off a surface given the gradient of the wedge or rotation of the wheel. In another embodiment, the male and female members can be coupled via a gear assembly or a mechanized Acme thread via a ready rod. In another embodiment, the system can assist the lifting of the locked-axle wheel by raising a traction motor of the train via an air bag, hydraulic cylinder, jack, or other suitable lifting mechanism.

The system provides the technological benefit of no longer having to use a crane or slide a locked-axle rail vehicle to the next siding or repair location. The system can be deployed within 30 minutes to get the locomotive moving again to relieve mainline congestion. The present disclosure provides a technological solution missing from conventional systems by at least providing male and female members configured to be driven together to lift a locked-axle wheel, securing the crane-less locked axle cradle around the wheel by disposing arms within receiver openings, and at least one locked-wheel wedge angled to have a gradient sufficient to raise a rail vehicle vehicle off a rail when the male and female members are fully-engaged.

It is an object of the invention to provide a locked-axle wheel cradle. It is a further object of the invention to provide a locked-axle wheel cradle system. It is a further object of the invention to provide a method of lifting a locked-axle wheel. These and other objects are provided by at least the following embodiments.

In one embodiment, a locked-axle wheel cradle, can include: a receiver member having a first wheel member, a receiver opening, and a first locked-wheel engager; a connector member having a second wheel member, an arm, and a second locked-wheel engager; wherein the receiver opening is configured to receive the arm to couple the locked-axle wheel cradle around at least a portion of a locked-axle wheel, and wherein the first locked-wheel engager and the second locked-wheel engager are configured to lift the locked-axle wheel off a surface. Wherein the first locked-wheel engager and the second locked-wheel engager each include a wedge. Further comprising at least one roller coupled to the first locked-wheel wedge and configured to slide the locked-axle wheel along the first locked-wheel wedge. Further comprising at least one roller coupled to the second locked-wheel wedge and configured to slide the locked-axle wheel along the second locked-wheel wedge. Wherein the roller is a ball bearing. Wherein the roller is a cylindrical roller. Wherein the surface is a railroad track rail. The first locked-wheel engager and the second locked-wheel engager include a wheel. Further comprising a puller configured to at least partially mate the receiver member with the connector member to lift the locked-axle wheel. Wherein the puller includes a gear. Wherein the puller includes acme screws. Wherein the puller includes a ball-screw. Wherein the puller includes an electronic actuator. Wherein the first and second wheel members include a tire.

In another embodiment, a locked-axle wheel cradle system, can include: a receiver member having a first wheel member, a receiver opening, and a first locked-wheel engager; a connector member having a second wheel member, an arm, and a second locked-wheel engager; a pressure-controlled lifting device configured to temporarily lift at least a portion of a vehicle structure; wherein the receiver opening is configured to receive the arm to couple the locked-axle wheel cradle around at least a portion of a locked-axle wheel, and wherein the first locked-wheel engager, the second locked-wheel engager, and the pressure-controlled lifting device are configured to lift the locked-axle wheel off a surface. Wherein the first locked-wheel engager and the second locked-wheel engager each include a wedge. Further comprising at least one roller coupled to the first locked-wheel wedge and configured to slide the locked-axle wheel along the first locked-wheel wedge. Further comprising at least one roller coupled to the second locked-wheel wedge and configured to slide the locked-axle wheel along the second locked-wheel wedge. Wherein the roller is a ball bearing. Wherein the roller is a cylindrical roller. Wherein the surface is a railroad track rail. Wherein the first locked-wheel engager and the second locked-wheel engager each include a wheel. Wherein the pressure-controlled lifting device is an airbag, hydraulic cylinder, or jack. Further comprising a puller configured to at least partially mate the receiver member with the connector member to lift the locked-axle wheel. Wherein the puller includes a gear. Wherein the puller includes acme screws. Wherein the puller includes a ball-screw. Wherein the puller includes an electronic actuator. Wherein the first and second wheel members include a tire.

In another embodiment, a method of lifting a locked-axle wheel, can include: positioning a receiver member having a first wheel member, a receiver opening, and a first locked-wheel engager proximate a first side of a locked-axle wheel; positioning a connector member having a second wheel member, an arm, and a second locked-wheel engager proximate a second side of the locked-axle wheel; coupling the receiver member with the connector member by inserting the arm into the receiver opening to form a locked-axle wheel cradle around at least a portion of a locked-axle wheel; and lifting the locked-axle wheel off a surface by coupling the receiver member with the connector member. Further comprising lifting at least a portion of a vehicle structure coupled to the locked-axle wheel via a pressure-controlled lifting device. Wherein the first locked-wheel engager and the second locked-wheel engager each include a wedge or wheel. Further comprising a puller configured to at least partially mate the receiver member with the connector member to lift the locked-axle wheel. Wherein the puller includes a gear. Wherein the puller includes acme screws. Wherein the puller includes a ball-screw. Wherein the puller includes an electronic actuator. Wherein the first and second wheel members include a tire.

BRIEF DESCRIPTION OF THE DRAWINGS

The present disclosure will be readily understood by the following detailed description, taken in conjunction with the accompanying drawings that illustrate, by way of example, the principles of the present disclosure. The drawings illustrate the design and utility of one or more exemplary embodiments of the present disclosure, in which like elements are referred to by like reference numbers or symbols. The objects and elements in the drawings are not necessarily drawn to scale, proportion, or precise positional relationship. Instead, emphasis is focused on illustrating the principles of the present disclosure.

DETAILED DESCRIPTION

The disclosure presented in the following written description and the various features and advantageous details thereof, are explained more fully with reference to the non-limiting examples included in the accompanying drawings and as detailed in the description. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can recognize the members of the genus. Accordingly, these examples should not be construed as limiting the scope of the claims.

A person of ordinary skill in the art would understand that any system claims presented herein encompass all of the elements and limitations disclosed therein, and as such, require that each system claim be viewed as a whole. Any reasonably foreseeable items functionally related to the claims are also relevant. A patent examiner, after having obtained a thorough understanding of the disclosure and claims of the present application has searched the prior art as disclosed in patents and other published documents, e.g., non-patent literature. Therefore, as evidenced by issuance of this patent, the prior art fails to disclose or teach the elements and limitations presented in the claims as enabled by the specification and drawings, such that the presented claims are patentable under the applicable laws and rules of this jurisdiction.

Figure 1A:
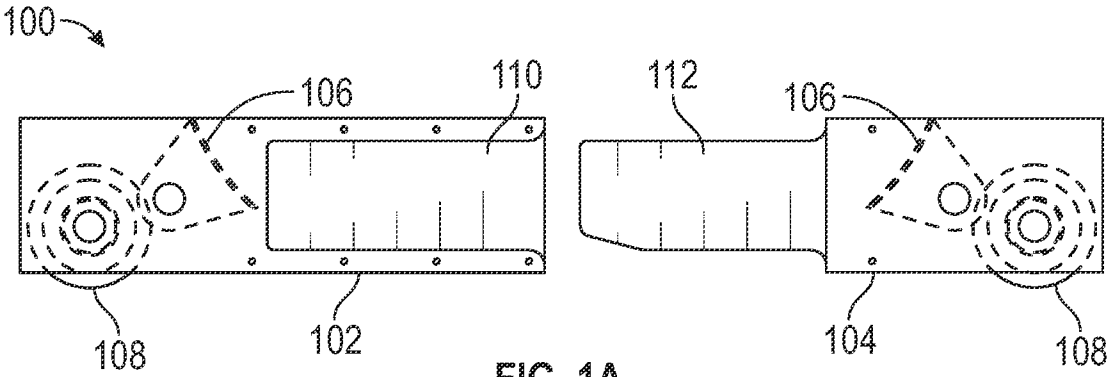
FIG. 1A illustrates a side-view of a locked-axle wheel cradle, in accordance with one or more exemplary embodiments of the present disclosure.

FIG. 1A illustrates a side-view of a locked-axle wheel cradle 100, in accordance with one or more exemplary embodiments of the present disclosure. In one embodiment, a locked-axle wheel cradle 100 can include a receiver member (female member) 102, a connector member (male member) 104, a locked-axle wheel wedge 106, a wheel member 108, a receiver opening 110, and an arm 112. The receiver member 102 can include a first wheel member 108, a first locked-axle wheel wedge 106, and a receiver opening 110. The connector member 104 can include a second wheel member 108, a second locked-axle wheel wedge 106, and a receiver opening 110. The arm 112 can include a ramp on at least a portion of the arm 112 to facilitate the insertion of the arm 112 into the receiver opening 110. In another embodiment, the receiver opening 110 can have rounded edges to facilitate receiving the arm 112. All components can be made of metal, steel (e.g., ANSI 1018), or other suitable material.

Figure 1B:
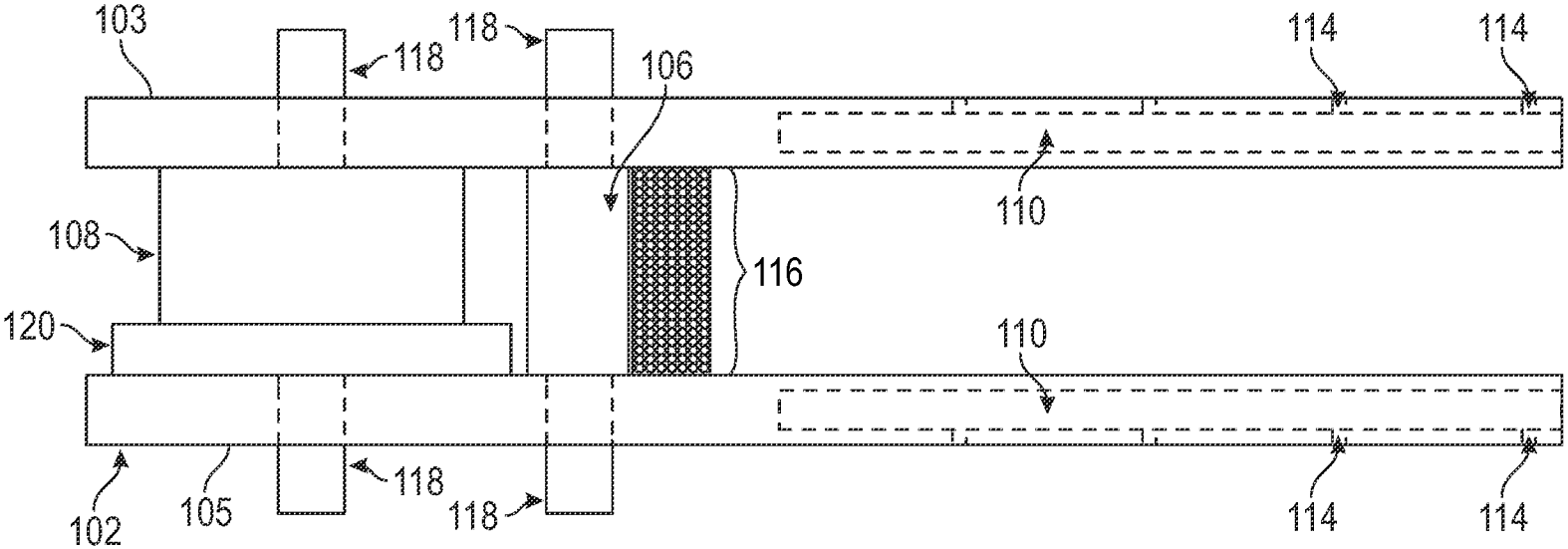
FIG. 1B illustrates a top-view of a receiver member of a locked-axle wheel cradle, in accordance with one or more exemplary embodiments of the present disclosure.

FIG. 1B illustrates a top-view of a receiver member of a locked-axle wheel cradle, in accordance with one or more exemplary embodiments of the present disclosure. The receiver member 102 can include two receiver plates 103, 105 having a plurality of plate holes disposed therethrough to facilitate the alignment of the receiver plates 103, 105 with each other and the insertion of one or more dowels 118 therethrough. Each receiver plate 103, 105 can include a receiver opening 110. In one embodiment, the dowel 118 can allow the first member wheel 108 to rotate about its center point. The dowels 118 can be welded or threaded through the plate holes to ensure that the two receiver plates 103, 105 are securely coupled. In another embodiment, the first member wheel 108 can include a flange 120. For example, the flange 120 can allow the first member wheel 108 to travel along a railroad track rail. In another embodiment, the first member wheel 108 can include a tire (not shown). For example, the tire can allow the first member wheel 108 to travel along a road. In another embodiment, the first locked-axle wheel wedge 106 can be positioned and maintained in place via a dowel 118. For example, the dowel 118 can protrude from one side of the first receiver plate 103 of the receiver member 102 through the first member wheel 108 and protrude outside of the second receiver plate 105 of the receiver member 102. The protruding portions of the dowel 118 can be used to attach various components and elements to the receiver member 102. The first locked-axle wheel wedge 106 can include a gradient configured to engage a locked-axle wheel and lift the locked-axle wheel off a surface. For example, the gradient can cause the locked-axle wheel to lift off a surface as the locked-axle wheel travels along the gradient. In another embodiment, at least a portion of the first locked-axle wheel wedge 106 can include at least one roller 116. For example, a roller 116 can be a bearing (ball or cylindrical) or any suitable device configured to reduce friction between two surfaces. The roller 116 can include at least one bearing per locked-axle wheel wedge 106.

In another embodiment, a receiver opening 110 can be disposed at least partially through each of the receiver plates 103, 105 of the receiver member 102. Each of the receiver plates 103, 105 of the receiver remember 102 can include one or more receiver holes 114 configured to receive screws, rivets, or other suitable joining devices. The receiver opening 110 can be sized and shaped to receive an arm of a connector member 104. In another embodiment, the receiver member 102 can include one or more rails proximate opening 110 to guide the arm 112 into the receiver opening 110.

Figure 1C:
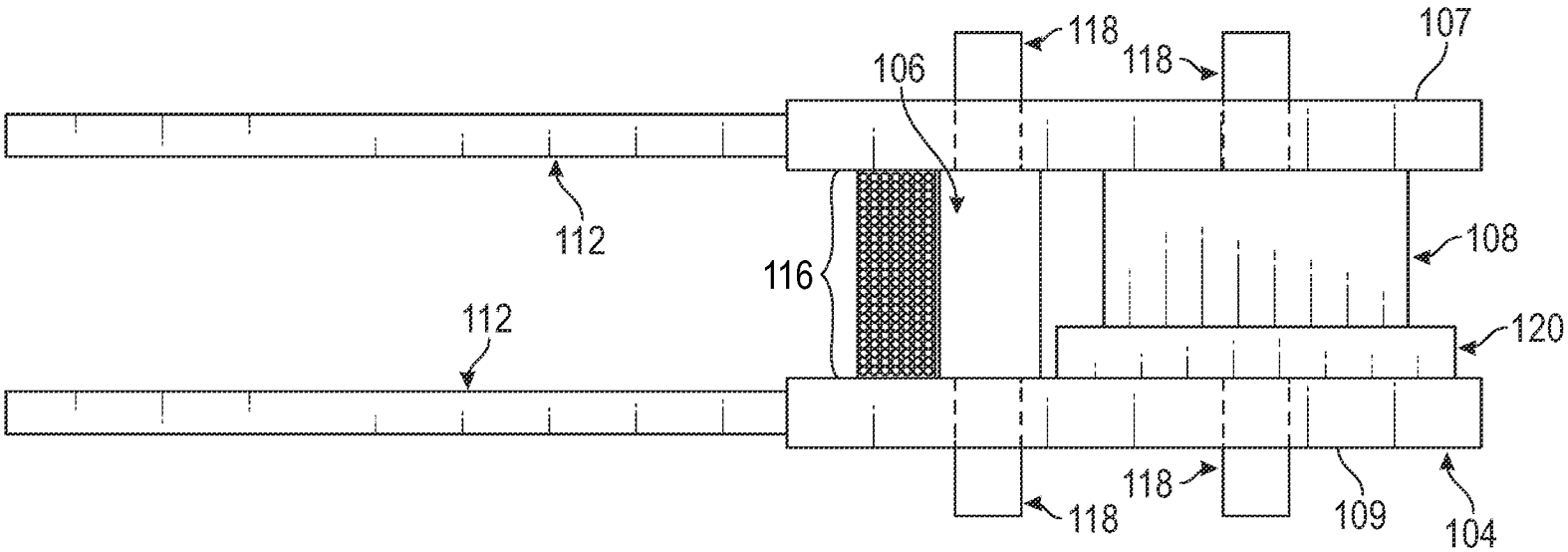
FIG. 1C illustrates a top-view of a connector member of a locked-axle wheel cradle, in accordance with one or more exemplary embodiments of the present disclosure.

FIG. 1C illustrates a top-view of a connector member of a locked-axle wheel cradle, in accordance with one or more exemplary embodiments of the present disclosure. The connector member 104 can include two connector plates 107, 109 having a plurality of connector plate holes disposed therethrough to facilitate the alignment of the connector plates 107, 109 with each other and the insertion of one or more dowels 118 therethrough. In one embodiment, the dowel 118 can allow the second member wheel 108 to rotate about its center point. The dowels 118 can be welded or threaded through the connector plate holes to ensure that the two connector plates 107, 109 are securely coupled. In another embodiment, the second member wheel 108 can include a flange 120. For example, the flange 120 can allow the second member wheel 108 to travel along a railroad track rail. In another embodiment, the second member wheel 108 can include a tire (not shown). For example, the tire can allow the second member wheel 108 to travel along a road. In another embodiment, the first locked-axle wheel wedge 106 can be positioned and maintained in place via a dowel 118. For example, the dowel 118 can protrude from one side of a first connector plate 107 of the connector member 104 through the second member wheel 108 and protrude for another side of the second connector plate 109 of the connector member 104. The protruding portions of the dowel 118 can be used to attach various components and elements to the connector member 104. The second locked-axle wheel wedge 106 can include a gradient configured to engage a locked-axle wheel and lift the locked-axle wheel off a surface. For example, the gradient can cause the locked-axle wheel to lift off a surface as the locked-axle wheel travels along the gradient. In another embodiment, at least a portion of the second locked-axle wheel wedge 106 can include at least one roller 116. For example, a roller 116 can be a bearing (ball or cylindrical) or any suitable device configured to reduce friction between two surfaces. The roller 116 can include at least one bearing per locked-axle wheel wedge 106.

Figure 1D:
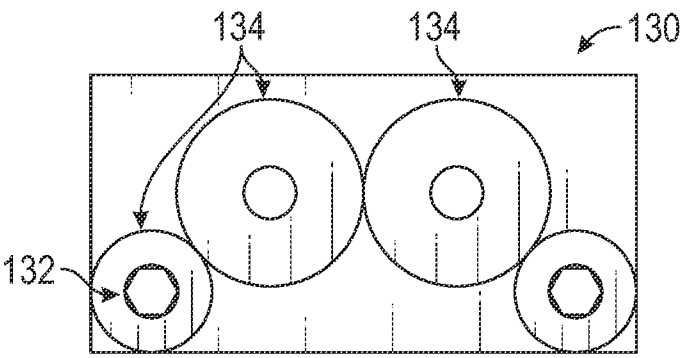
FIG. 1D illustrates a schematic front-view of a gearbox for a locked-axle wheel cradle, in accordance with one or more exemplary embodiments of the present disclosure.
Figure 1E:
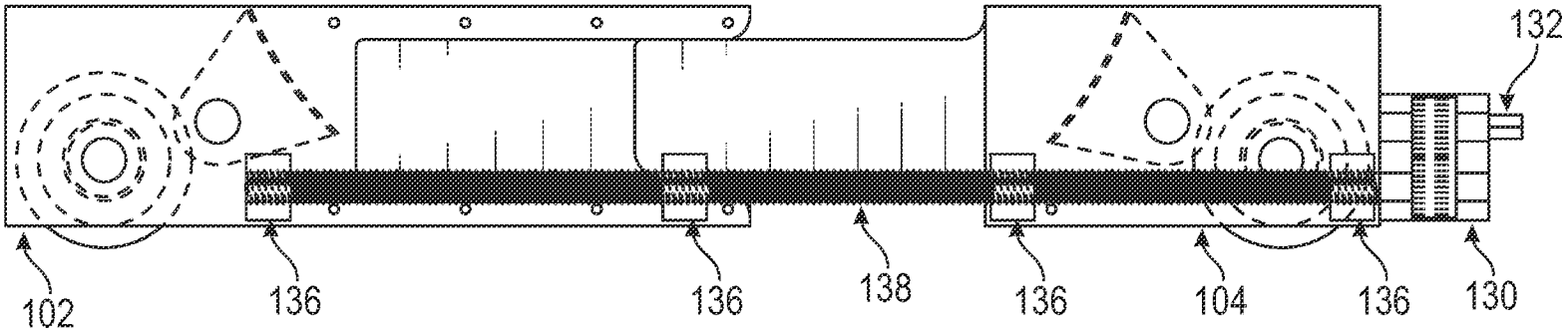
FIG. 1E illustrates a side-view of a gearbox puller for a locked-axle wheel cradle in a semi-engaged state, in accordance with one or more exemplary embodiments of the present disclosure.
Figure 1F:
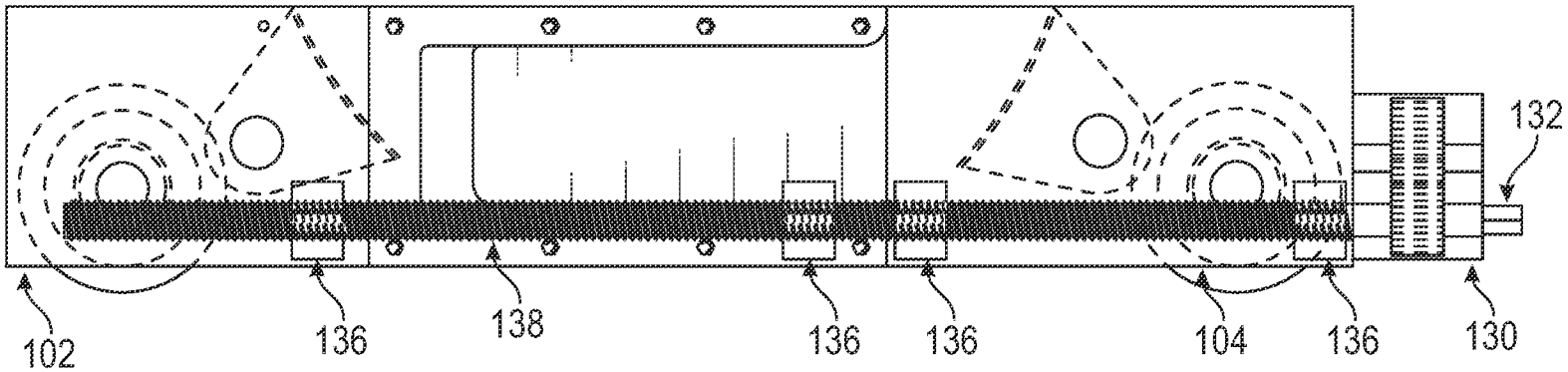
FIG. 1F illustrates a side-view of a gearbox puller for a locked-axle wheel cradle in a fully-engaged state, in accordance with one or more exemplary embodiments of the present disclosure.

FIGS. 1D-1F illustrate various aspects of a gearbox puller for a locked-axle wheel cradle, in accordance with one or more exemplary embodiments of the present disclosure. FIG. 1D illustrates a schematic front-view of a gearbox 130 for a locked-axle wheel cradle, in accordance with one or more exemplary embodiments of the present disclosure. In one embodiment, the gearbox 130 can include one or more gears 134 operable coupled to one another to operate a puller to pull receiver member 102 and connector member 104 towards each other. FIG. 1E illustrates a side-view of a gearbox puller for a locked-axle wheel cradle in a semi-engaged state, in accordance with one or more exemplary embodiments of the present disclosure. FIG. 1F illustrates a side-view of a gearbox puller for a locked-axle wheel cradle in a fully-engaged state, in accordance with one or more exemplary embodiments of the present disclosure. In one embodiment, a gearbox 130 can be operably coupled to a puller 138 to control the operation of the puller. For example, a gearbox can be operably coupled to one or more screws 138 coupled to the protruding sections of the dowels 118 or one or more puller points 136. For example, the puller points 136 can be threaded elements (e.g., screw nuts) that can receive screw 138 and pull the receiver member 102 and connector member 104 towards each other. The gearbox 130 can have an adapter 132 configured to couple with a torque wrench, pneumatic torque gun, or other suitable torque-inducing device to operate the puller. The application of torque on the adapter 132 in one direction can cause the puller 302 to pull the receiver member 102 to the connector member 104 and lift the locked-axle wheel 202. The application of torque on the adapter 132 in an opposite direction can cause the puller 302 to release the receiver member 102 away from the connector member 104 and lower the locked-axle wheel 202. The gearbox 130 can include one or more gears 134 operably coupled to one or more screws 138 such that the teeth of the gears cause the screws 138 to rotate, thereby positioning the receiver member 102 and connecter member 104 in either disengaged, semi-engaged, or fully-engaged positions. In another embodiment, the screws 138 can be acme screws. The gearbox 130 can be on any of the four sides of the locked-axle wheel cradle 100. In another embodiment, the gearbox 130 can operate the puller 302 (e.g., screw) facing away from the vehicle. In another embodiment, the gearbox 130 can operate the puller 302 facing toward the vehicle. In another embodiment, the gearbox 130 can simultaneously operate at least two pullers 302 (e.g., screws, ready-rods, or other suitable device) on opposing sides of the locked-axle wheel 202, among others.

Figure 2A:
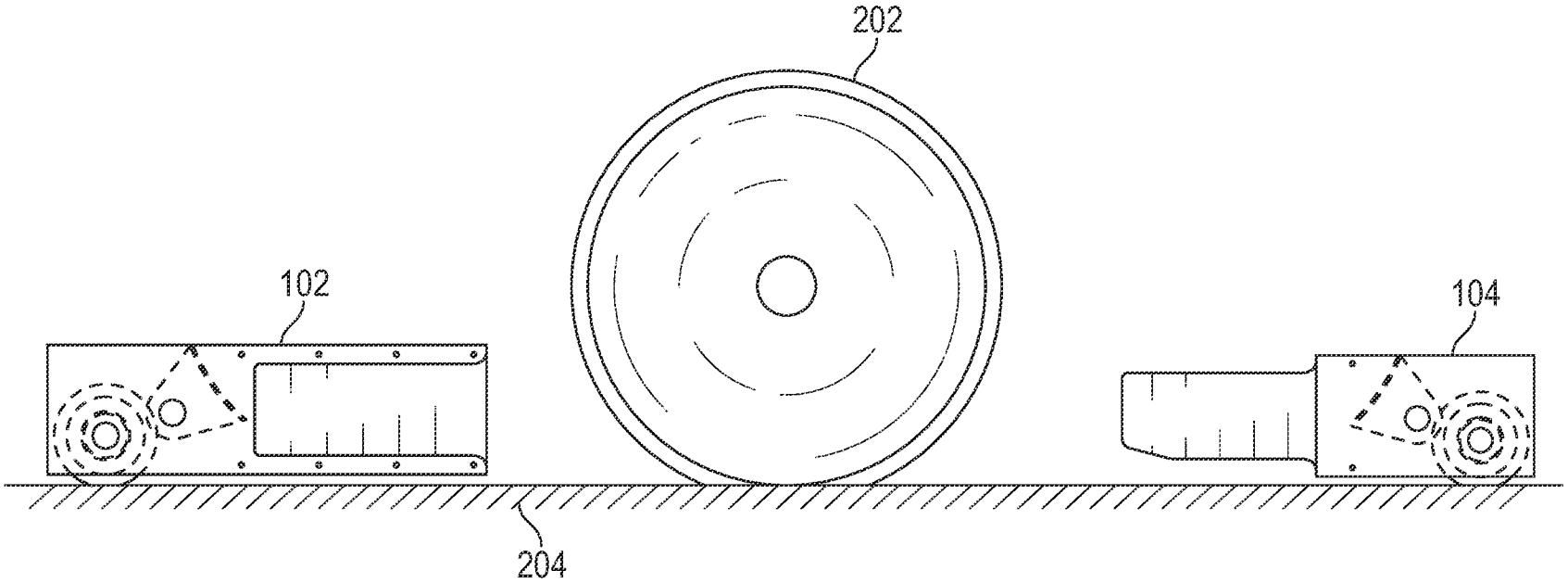
FIG. 2A illustrates a side-view of an unengaged receiver member and a connector member disposed on either side of a rail vehicle wheel, in accordance with one or more exemplary embodiments of the present disclosure.

FIG. 2A illustrates a side-view of an unengaged receiver member 102 and a connector member 104 disposed on either side of a locked-axle wheel 202, in accordance with one or more exemplary embodiments of the present disclosure. In operation, in one embodiment, the receiver member 102 and the connector member 104 can be aligned in-line with the locked-axle wheel 202, with the arms 112 and the receiver opening 110 directed toward each other as shown in FIG. 2A. The receiver member 102 and the connector member 104 can be on either side of the locked-axle wheel 202, so long as the arms 112 and the receiver opening 110 are positioned proximate each other such that arms 112 can be operably coupled to the receiver openings 110. In another embodiment, the receiver member 102 and the connector member 104 can include a locked-axle wheel engager coupled to a respective receiver member 102 and connector member 104 and configured to engage a wheel (the axle need not be locked). For example, the locked-axle wheel engager can be a wedge, roller, wheel, ball, ramp, contoured section, or other suitable component. As can be seen in FIG. 2A, the locked-axle wheel 202 is still touching the surface (e.g., a railroad track rail) 204, since the locked-axle wheel wedges 106 are not in contact with the locked-axle wheel 202.

Figure 2B:
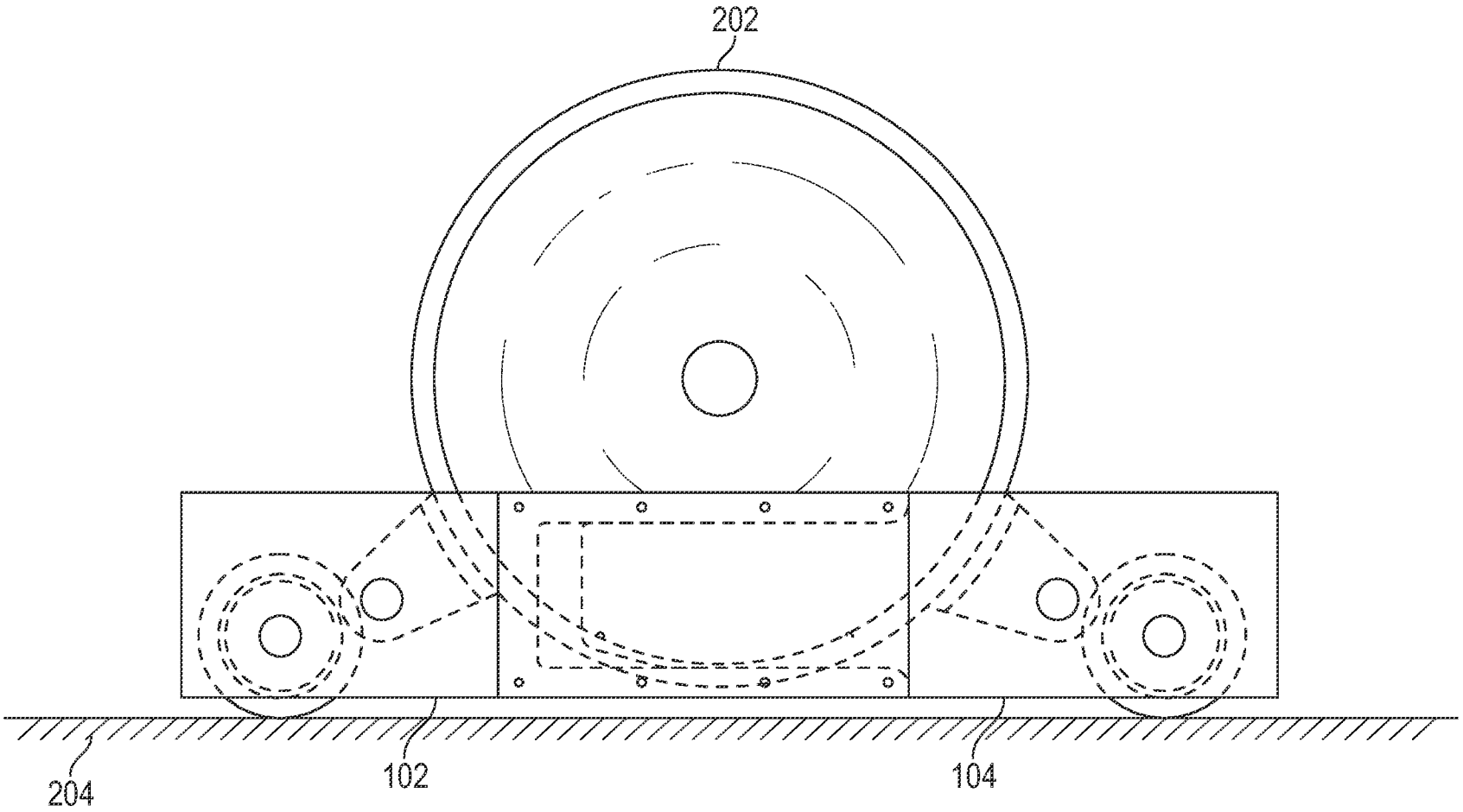
FIG. 2B illustrates a side-view of a fully-engaged receiver member and a connector member disposed on either side of a rail vehicle wheel, with the wheel lifted off of the rail via a wedge, in accordance with one or more exemplary embodiments of the present disclosure.

FIG. 2B illustrates a side-view of a fully-engaged receiver member 102 and a connector member 104 disposed on either side of a locked-axle wheel 202, with the locked-axle wheel 202 lifted off of a surface (e.g., a railroad track rail 204) via locked-axle wheel engagers 106 (e.g., wedge), in accordance with one or more exemplary embodiments of the present disclosure. In operation, in one embodiment, the locked-axle wheel 202 can be disposed between the plates 103, 105 of the receiver member 102 and the arms and/or plates 107, 109 of the connector member 104. A first arm 112 of the connector member 104 can be inserted into a first receiver opening 110 of the first plate 103 of receiver member 102. Concurrently, the second arm 112 of the connector member 104 can be inserted into a second receiver opening 110 of the second plate 105 of the receiver member 102. As can be seen in FIG. 2B, the locked-axle wheel 202 is no longer touching the surface (e.g., a railroad track rail) 204, since the locked-axle wheel engagers 106 are in contact with the locked-axle wheel 202. In another embodiment, the locked-axle wheel 202 can be raised at least a quarter (¼) of an inch off the surface 204. In another embodiment, the locked-axle wheel wedges 106 can rotate around their respective dowels 118 as they contact the locked-axle wheel 202. In another embodiment, the locked-axle wheel engager 106 (e.g., wedge) can be static as they contact the locked-axle wheel 202. The rotatable locked-axle wheel engager 106 that can rotate around their respective dowels 118 as they contact the locked-axle wheel 202 can potentially require less force to lift the locked-axle wheel 202, however, the static locked-axle wheel wedges 106 can provide a more stable lift, as they exert forces on the locked-axle wheel 202.

Figure 2C:
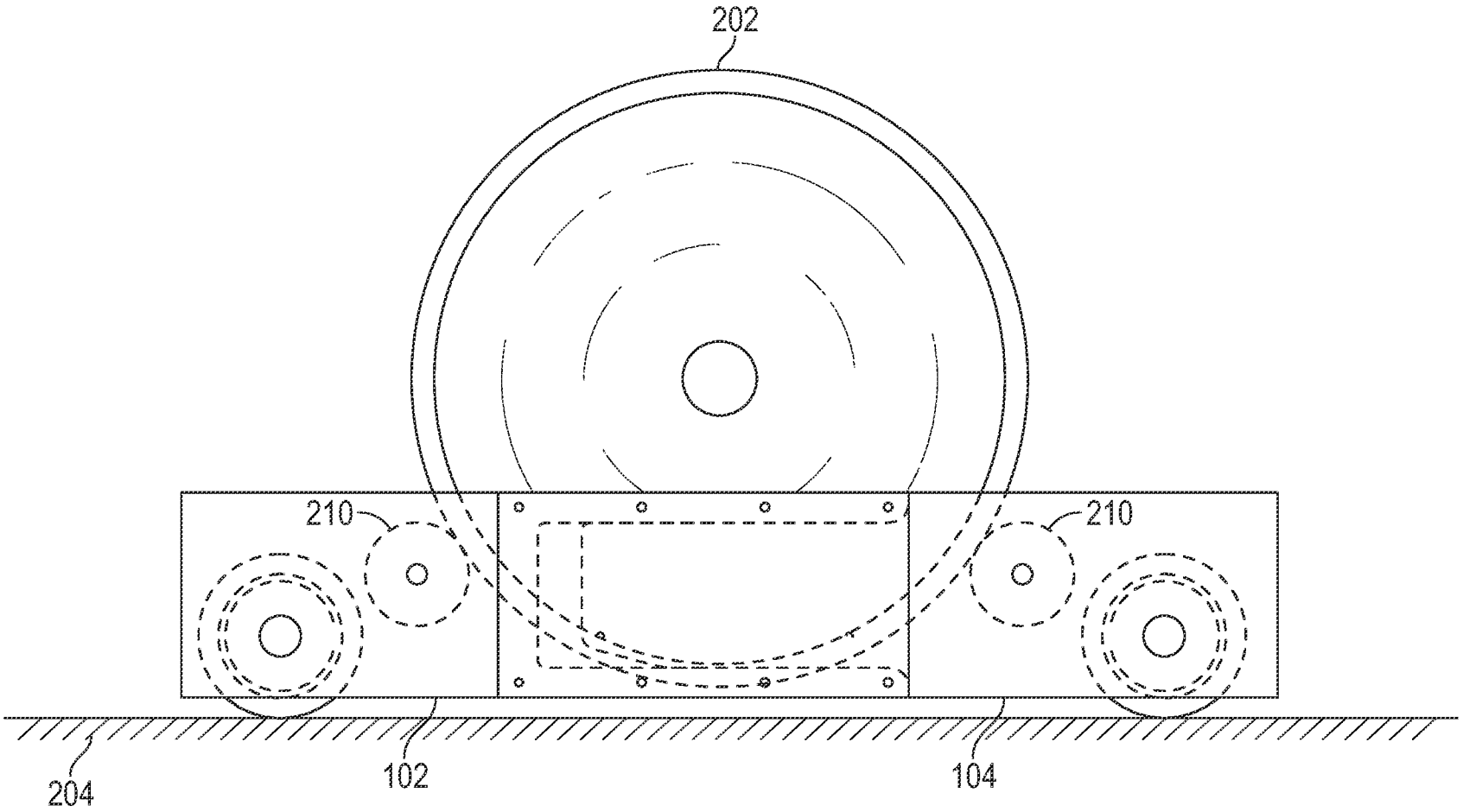
FIG. 2C illustrates a side-view of a fully-engaged receiver member and a connector member disposed on either side of a rail vehicle wheel, with the wheel lifted off of the rail via a roller, in accordance with one or more exemplary embodiments of the present disclosure.

FIG. 2C illustrates a side-view of a fully-engaged receiver member and a connector member disposed on either side of a rail vehicle wheel, with the wheel lifted off of a surface (e.g., a railroad track rail 204) via locked-axle wheel engagers 210 (e.g., wheels), in accordance with one or more exemplary embodiments of the present disclosure. In operation, in one embodiment, the locked-axle wheel 202 can be disposed between the plates 103, 105 of the receiver member 102 and the arms and/or plates 107, 109 of the connector member 104. A first arm 112 of the connector member 104 can be inserted into a first receiver opening 110 of the first plate 103 of receiver member 102. Concurrently, the second arm 112 of the connector member 104 can be inserted into a second receiver opening 110 of the second plate 105 of the receiver member 102. As can be seen in FIG. 2C, the locked-axle wheel 202 is no longer touching the surface (e.g., a railroad track rail) 204, since the locked-axle wheel engagers 210 are in contact with the locked-axle wheel 202. In another embodiment, the locked-axle wheel 202 can be raised at least a quarter (¼) of an inch off the surface 204. In another embodiment, the locked-axle wheel engager 210 can rotate around respective dowels disposed through the center point of the locked-axle wheel engager 210 as they contact the locked-axle wheel 202. The rotatable locked-axle wheel engagers 210 can rotate around their respective dowels as they contact the locked-axle wheel 202 to potentially require less force to lift the locked-axle wheel 202, however, the static locked-axle wheel engagers 210 can provide a more stable lift, as they exert forces on the locked-axle wheel 202. A smaller surface area of the locked-axle wheel engagers 210 contact the locked-axle wheel 202, resulting in less friction between the two.

Figure 3:
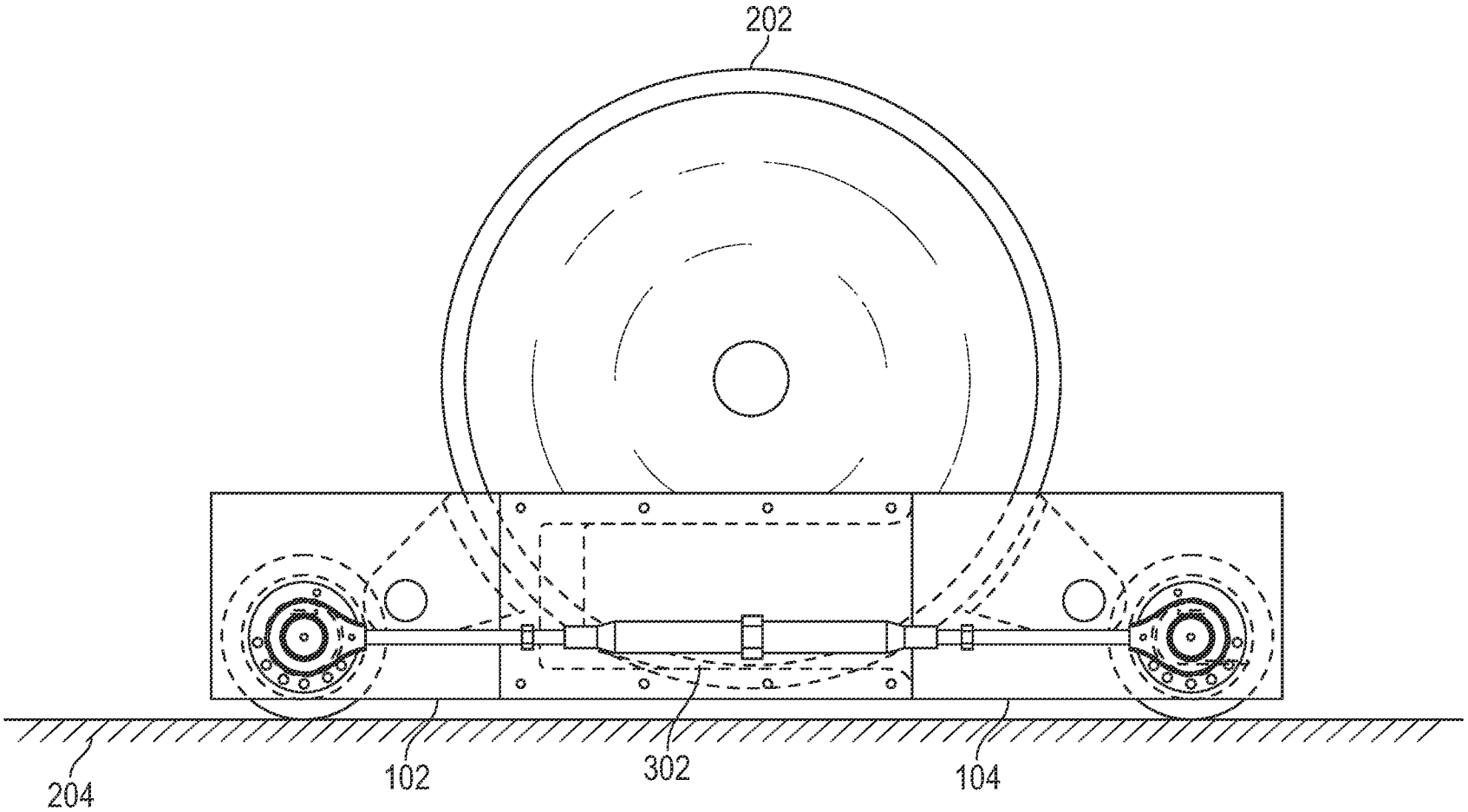
FIG. 3 illustrates a side-view of a fully-engaged crane-less locked axle cradle with a driving rod, in accordance with one or more exemplary embodiments of the present disclosure.

FIG. 3 illustrates a side-view of a fully-engaged locked-axle wheel 202 with a puller 302, in accordance with one or more exemplary embodiments of the present disclosure. A puller 302 can be coupled to the protruding portions of dowels 118 of the receiver member 102 and the protruding portions of dowels 118 of the connector member 104. The puller can be connected on one or both sides of the receiver member 102 and the connector member 104. The arms 112 of the connector member 104 can be secured to the receiver plates 103, 105 of the receiver member 102 by one or more screws, pins, rivets, welds, pullers, or other suitable retention mechanism. The puller 302 can also be left on the locked-axle wheel cradle 100 during transport to secure the receiver member 102 to the connector member 104. See FIGS. 1D-1F above for gearbox embodiments applicable to FIG. 3.

Figure 4A:
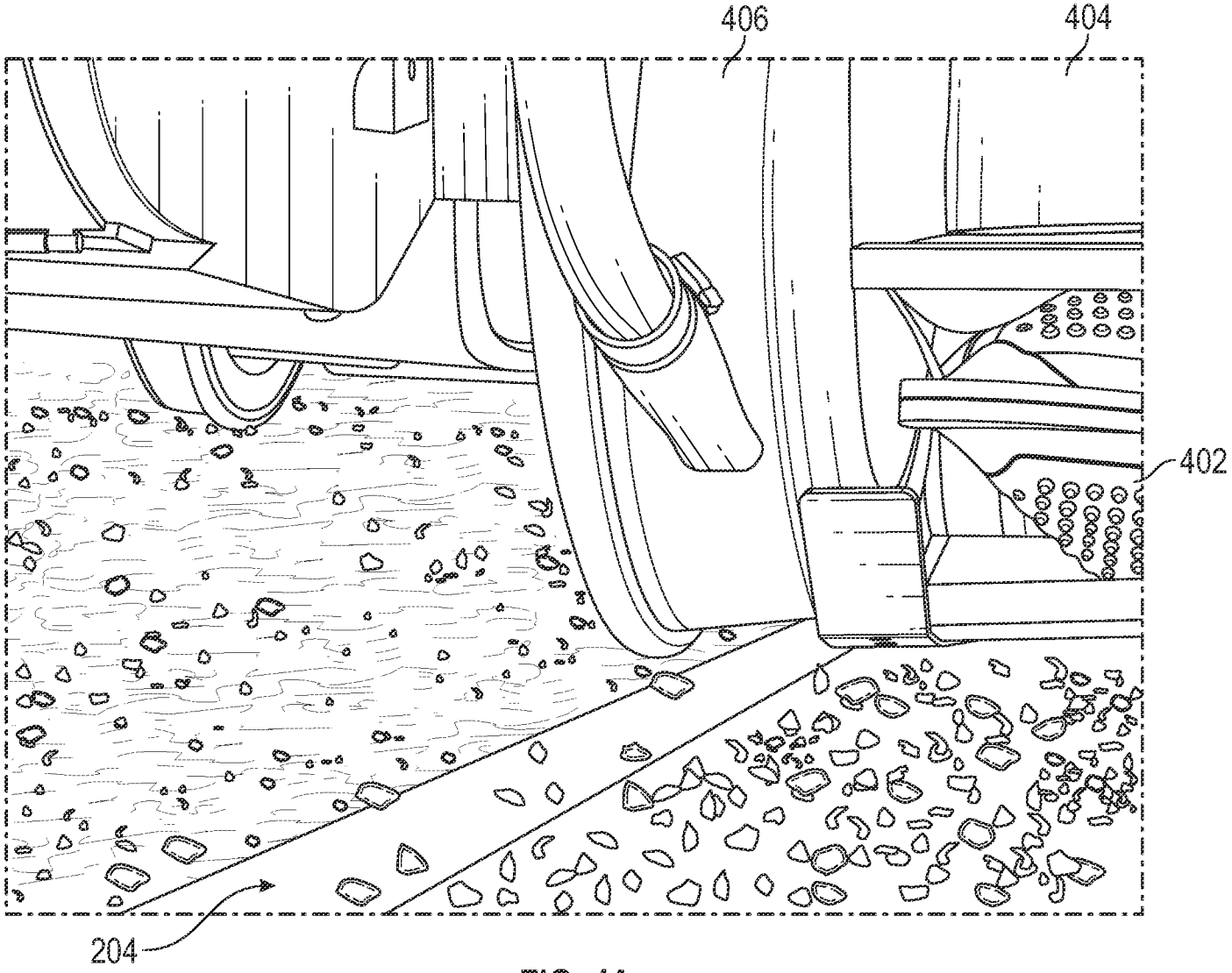
FIG. 4A illustrates a perspective-view of an airbag of a crane-less locked axle cradle configured to lift a locked-axle wheel off a rail, in accordance with one or more exemplary embodiments of the present disclosure.

FIG. 4A illustrates a perspective-view of an airbag 402 of a locked-axle wheel cradle system configured to lift a locked-axle wheel 406 off a rail, in accordance with one or more exemplary embodiments of the present disclosure. In one embodiment, the airbag can be a 2-ply Kevlar® lifting bag. For example, the airbag 402 can be a 35-ton pneumatic lifting bag. The airbag 402 can collapse to fit into tight spaces and operate using standard shop air, manual pump, or other suitable air-producing device to lift a vehicle structure 404 (e.g., a journal box or chassis). In operation, the locked-axle wheel cradle 100 can be assembled on either side of a locked-axle wheel 202. The puller can then be operated to engage and lift the locked-axle wheel 202. The airbag 402 can be inflated to lift a vehicle structure 404 and cause the locked-axle wheel cradle 100 to more-closely engage, lifting the locked-axle wheel 202 higher than possible with the locked-axle wheel cradle 100 alone. The locked-axle wheel 202 can then be transported. In another embodiment, boards can be used above and below the airbag 402 to prevent puncture.

Figure 4B:
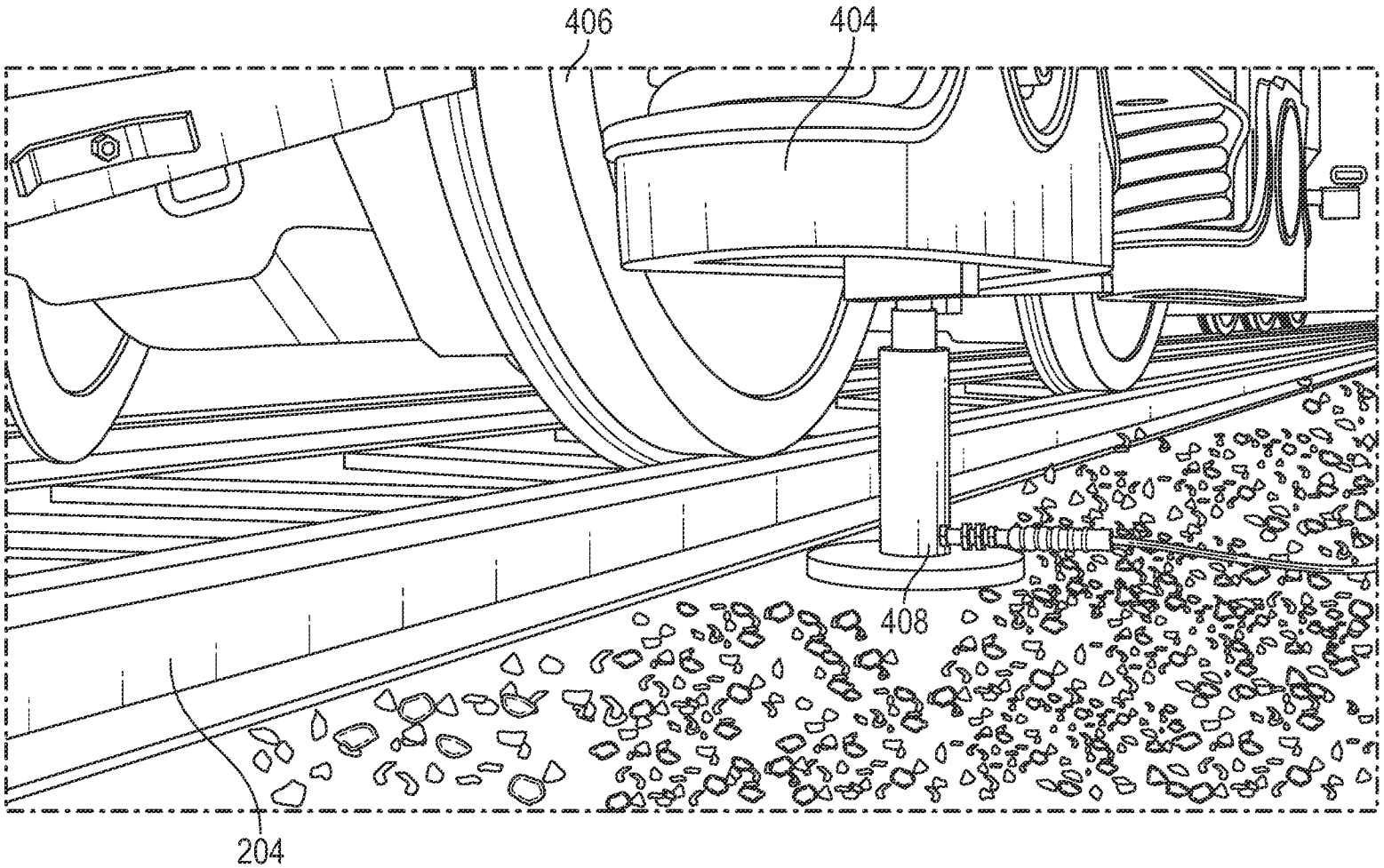
FIG. 4B illustrates a perspective-view of a bottle jack of a crane-less locked axle cradle configured to lift a locked-axle wheel off a rail, in accordance with one or more exemplary embodiments of the present disclosure.

FIG. 4B illustrates a perspective-view of a bottle jack 408 of a locked-axle wheel cradle system configured to lift a locked-axle wheel 406 off a surface 204, in accordance with one or more exemplary embodiments of the present disclosure. Pursuant to the process of FIG. 4A with an airbag 402, a bottle jack 408 can be used instead. The bottle jack 408 can be a 35-ton bottle jack. The bottle jack 408 can collapse to fit into tight spaces and operate using standard shop air, manual pump, or other suitable air-producing device to lift a vehicle structure 404 (e.g., a journal box or chassis). In operation, the locked-axle wheel cradle 100 can be assembled on either side of a locked-axle wheel 202. The puller can then be operated to engage and lift the locked-axle wheel 202. The bottle jack 408 can be pneumatically raised to lift a vehicle structure 404 and cause the locked-axle wheel cradle 100 to more-closely engage, lifting the locked-axle wheel 202 higher than possible with the locked-axle wheel cradle 100 alone. The locked-axle wheel 202 can then be transported. The airbag 402 and bottle jack 408 can be used when there is insufficient torque to lift the locked-axle wheel 202 off the surface 204 via the locked-axle wheel cradle 100 alone. Once the wheel is off the surface 204, the member wheels 108 of the locked-axle wheel cradle 100 can allow the unit to be safely rolled to a desired location.

The present disclosure achieves at least the following advantages:

1. Safer and faster (no crane and no cut pinions);
2. Reduced costs and manpower; and
3. Fewer delays resulting in increased network speed.

Persons skilled in the art will readily understand that advantages and objectives described above would not be possible without the particular combination of structural components and mechanisms assembled in this inventive system and described herein. Moreover, the particular choice of components may be governed by the specific objectives and constraints placed on the implementation selected for realizing the concepts set forth herein and in the appended claims.

The description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f). Even under the broadest reasonable interpretation, in light of this paragraph of this specification, the claims are not intended to invoke 35 U.S.C. § 112(f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the inventions can be established by the appended claims rather than by the foregoing description. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

What is claimed is:

1. A locked-axle wheel cradle, comprising:

a receiver member having a first wheel member and a first locked-wheel engager;

a connector member having a second wheel member and a second locked-wheel engager;

a puller coupled to the receiver member and the connector member and configured to pull the receiver member and the connector member towards each other to at least partially mate the receiver member with the connector member to lift a wheel off a surface; and a gearbox having one or more gears configured to operate the puller to pull the receiver member and connector member towards each other.

2. The locked-axle wheel cradle of claim 1, wherein the first locked-wheel engager and the second locked-wheel engager each include a wedge.

3. The locked-axle wheel cradle of claim 2, further comprising at least one roller coupled to the first locked-wheel wedge and configured to slide the locked-axle wheel along the first locked-wheel wedge.

4. The locked-axle wheel cradle of claim 2, further comprising at least one roller coupled to the second locked-wheel wedge and configured to slide the locked-axle wheel along the second locked-wheel wedge.

5. The locked-axle wheel cradle of claim 4, wherein the roller is a ball bearing.

6. The locked-axle wheel cradle of claim 1, wherein a receiver opening of the receiver member is configured to receive an arm of the connector member to couple the locked-axle wheel cradle around at least a portion of a locked-axle wheel.

7. The locked-axle wheel cradle of claim 1, wherein the surface is a railroad track rail.

8. The locked-axle wheel cradle of claim 1, wherein the first locked-wheel engager and the second locked-wheel engager include a wheel.

9. The locked-axle wheel cradle of claim 1, wherein the gearbox includes an adapter configured to couple to a torque-inducing device.

10. The locked-axle wheel cradle of claim 9, wherein the torque-inducing device is a torque wrench or pneumatic torque gun.

11. A method of lifting a locked-axle wheel, comprising:

positioning a receiver member having a first wheel member, a receiver opening, and a first locked-wheel engager proximate a first side of a locked-axle wheel;

positioning a connector member having a second wheel member, an arm, and a second locked-wheel engager proximate a second side of the locked-axle wheel;

coupling a puller to the receiver member and the connector member to pull the receiver member and the connector member towards each other to at least partially mate the receiver member with the connector member to lift a wheel off a surface; and operating a gearbox to cause a puller to draw the receiver member and connector member towards each other.

12. The method of claim 11, further comprising lifting at least a portion of a vehicle structure coupled to the locked-axle wheel via a pressure-controlled lifting device.

13. The method of claim 11, wherein the first locked-wheel engager and the second locked-wheel engager each include a wedge or wheel.

14. The method of claim 13, further comprising at least one roller coupled to the first locked-wheel wedge and configured to slide the locked-axle wheel along the first locked-wheel wedge.

15. The method of claim 11, further comprising at least one roller coupled to the second locked-wheel wedge and configured to slide the locked-axle wheel along the second locked-wheel wedge.

16. The method of claim 15, wherein the roller is a ball bearing.

17. The method of claim 11, wherein a receiver opening of the receiver member is configured to receive an arm of the connector member to couple the locked-axle wheel cradle around at least a portion of a locked-axle wheel.

18. The method of claim 11, wherein the surface is a railroad track rail.

19. The method of claim 11, wherein the gearbox includes an adapter configured to couple to a torque-inducing device.

20. The method of claim 19, wherein the torque-inducing device is a torque wrench or pneumatic torque gun.

* * * * *